US011384762B2

(12) United States Patent
Fabry

(10) Patent No.: US 11,384,762 B2
(45) Date of Patent: Jul. 12, 2022

(54) CYLINDRICAL SYMMETRIC VOLUMETRIC MACHINE

(71) Applicant: ATLAS COPCO AIRPOWER, NAAMLOZE VENNOOTSCHAP, Wilrijk (BE)

(72) Inventor: Erik Paul Fabry, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 210 days.

(21) Appl. No.: 16/635,814

(22) PCT Filed: Sep. 11, 2018

(86) PCT No.: PCT/IB2018/056924

§ 371 (c)(1),
(2) Date: Jan. 31, 2020

(87) PCT Pub. No.: WO2019/058213

PCT Pub. Date: Mar. 28, 2019

(65) Prior Publication Data

US 2020/0217320 A1 Jul. 9, 2020

(30) Foreign Application Priority Data

Sep. 21, 2017 (BE) ..... 2017/5672

(51) Int. Cl.
*F04C 29/02* (2006.01)
*F04C 23/02* (2006.01)
(Continued)

(52) U.S. Cl.
CPC ..... *F04C 29/026* (2013.01); *F04C 2/102* (2013.01); *F04C 23/02* (2013.01); *F04C 29/042* (2013.01)

(58) Field of Classification Search
CPC ..... F04C 29/026; F04C 2/102; F04C 23/02; F04C 29/042; F04C 2/1076; F04C 2/1078; F04C 2/1071
See application file for complete search history.

(56) References Cited

U.S. PATENT DOCUMENTS 3,311,094 A * 3/1967 Kehl ..... F02B 53/00 123/220
4,602,595 A * 7/1986 Aoki ..... F01M 13/0416 123/41.86

(Continued)

FOREIGN PATENT DOCUMENTS

EP 2 113 667 A1 11/2009
JP 2008-157199 A 7/2008

(Continued)

OTHER PUBLICATIONS

Int. Search Report & Written Opinion dated Dec. 21, 2018 issued by the Int. Searching Authority in Application No. PCT/IB2018/056924 (PCT/ISA/210 & PCT/ISA/237).

*Primary Examiner* — Connor J Tremarche
(74) *Attorney, Agent, or Firm* — Sughrue Mion, PLLC

(57) ABSTRACT

A cylindrical symmetric volumetric machine, includes a housing (2) with an inlet opening (3) and an outlet opening (4), with an outer rotor (6*a*) which is mounted rotatably in the housing (2) and an inner rotor (6*b*) which is mounted rotatably in the outer rotor (6*a*), whereby liquid is injected in the machine (1). At the outlet opening (4) on the level of the inner rotor (6*b*) and outer rotor (6*a*) a liquid separation takes place, whereby the separated liquid ends up in the machine (1) again, and in that the outer rotor (6*a*) has an axial extension (17) on the level of the outlet opening (4) which extends around this outlet opening (4) almost up (Continued)

against the housing (2) such that a space (19) is located between the axial extension (17) and the housing (2).

20 Claims, 4 Drawing Sheets

(51) Int. Cl.
*F04C 29/04* (2006.01)
*F04C 2/10* (2006.01)

(56) References Cited

U.S. PATENT DOCUMENTS

| | | | | |
|---|---|---|---|---|
| 5,857,842 | A * | 1/1999 | Sheehan | F04C 15/0069 417/420 |
| 10,480,506 | B2 * | 11/2019 | Dmitriev | F04C 2/107 |
| 2010/0092317 | A1 * | 4/2010 | Suhara | F04C 15/008 417/410.4 |
| 2017/0045053 | A1 * | 2/2017 | Ge | F04C 29/04 |

FOREIGN PATENT DOCUMENTS

| | | |
|---|---|---|
| TW | 477859 | 3/2002 |
| TW | M344393 | 11/2008 |
| WO | 99/15755 A2 | 4/1999 |

* cited by examiner

CYLINDRICAL SYMMETRIC VOLUMETRIC MACHINE

CROSS REFERENCE TO RELATED APPLICATIONS

This application is a National Stage of International Application No. PCT/IB2018/056924, filed Sep. 11, 2018, claiming priority based on Belgian Patent Application No. BE 2017/5672 filed on Sep. 21, 2017, the contents of all of which are incorporated herein by reference in their entirety.

BACKGROUND OF THE INVENTION

Field of the Invention

The present invention relates to a cylindrical symmetric volumetric machine.

Background

A volumetric machine is also known under the name "positive displacement machine".

In particular, the invention is intended for machines such as expanders, compressors and pumps with a cylindrical symmetry with two rotors, namely an inner rotor mounted rotatably in an outer rotor.

Such machines are already known and are described in U.S. Pat. No. 1,892,217 among others. It is also known that the rotors can have a cylindrical or conical shape.

It is known that such machines can be driven with an electric motor.

From Belgian patent application no. BE 2017/5459 it is already known that the electric motor can be mounted around the outer rotor, whereby the motor stator directly drives the outer rotor.

Such machine has many advantages in relation to the known machines whereby the motor shaft is connected by means of a transmission with the rotor shaft of the outer or inner rotor.

Thus, the machine will not only be a lot more compact, such that the footprint is smaller, it also means less shaft seals and bearings are required.

In known machines and the machine of BE 2017/5459, the rotors, bearings and other components need to be lubricated and cooled. An injection circuit is provided for this which will inject a liquid, such as oil or water, for example, in the machine, for lubrication, sealing and cooling. This injection circuit also comprises a system to pressurise the liquid and to be able to inject it in the machine.

There is also an injection of liquid between the inner rotor and the outer rotor, whereby this injection necessarily takes place at the inlet, which results in an increase of the inlet temperature.

There can also be an injection of liquid on the level of the motor, whereby the motor stator is provided with slots to let the liquid pass through. The motor may also be air-cooled.

As the liquid is also injected between the inner rotor and outer rotor, the gas will contain an amount of liquid at the outlet of the machine. That is why it is necessary that downstream from the machine a liquid separation takes place, whereby the injected liquid is separated from the gas.

Consequently, not only a separate liquid separator needs to be provided. Furthermore, in the case of a compressor, this also means a pressure loss.

The purpose of the present invention is to improve the lubrication and cooling for a machine as specified in BE 2017/5459.

SUMMARY OF THE INVENTION

To this end, the invention relates to a cylindrical symmetric volumetric machine, whereby the machine comprises a housing with an inlet opening and an outlet opening, with two co-operating rotors in the housing, namely an outer rotor which is mounted rotatably in the housing and an inner rotor which is mounted rotatably in the outer rotor, whereby liquid is injected in the machine, characterised in that at the outlet opening on the level of the inner rotor and outer rotor, a liquid separation takes place, whereby the separated liquid flows back into the machine, and in that the outer rotor has an axial extension on the level of the outlet opening which extends around this outlet opening almost up against the housing such that between the axial extension and the housing there is a space.

As both the inner rotor and the outer rotor will rotate at high speed at the outlet opening, the liquid particles will be flung outward by the centrifugal forces, i.e. toward the inside of the outer rotor. In this way they will be removed from the compressed air.

This provides the advantage that no separate liquid separator needs to be included, but that the separation happens in the machine itself.

Not only will this make the machine more compact, it will also ensure that, in the case the machine is a compressor, the pressure loss in the liquid separator can be avoided.

Preferably at least a part of the separated liquid ends up back into the machine via the liquid channels in the outer rotor.

'Liquid channels in the outer rotor' means that the liquid channels effectively run through the outer rotor. In other words, the outer rotor is provided with hollow channels in which or through which liquid can flow.

By providing liquid channels in the outer rotor, these particles can be collected and drained via the liquid channels.

The outer rotor has an axial extension on the level of the outlet opening, which extends around this outlet opening almost up against the housing such that between the axial extension and the housing there is a space.

Due to the centrifugal forces and the movement of the gas toward the outlet opening, the liquid particles will end up in said space between the housing and the axial extension of the outer rotor. The liquid can then be drained via this space.

Preferably a liquid channel extends in the axial extension which ends in the space between the housing and the axial extension.

Because the liquid ends up in the space, a kind of axial bearing will form between the housing and the outer rotor. As a result of this the forces that work on the ball bearing which supports the outer rotor, will become smaller. Consequently, a smaller ball bearing can be applied.

In a practical embodiment, the liquid channels in the outer rotor lead to one or more of the following locations:

- one or more injection points to the space between the inner rotor and the outer rotor;
- one or more injection points to one or more bearings of the machine.

The liquid channels allow the liquid to be led to the desired locations that need lubrication and/or cooling.

This provides the advantage that the injection between the inner rotor and the outer rotor does not have to be at the inlet side as the liquid channels can be made to end downstream from the inlet side to the space between the inner rotor and the outer rotor. This avoids an increase of the inlet temperature following injection at the inlet opening.

According to a preferred characteristic of the invention, the outer rotor has an open structure with passages for the sucked in gas, such that gas that is sucked in via the inlet opening must pass via the passages of the open structure before it ends up between the inner rotor and the outer rotor.

This has the advantage that a kind of air cooling of the machine is obtained, whereby the outer rotor can be cooled by the sucked in air.

This principle will also allow cooling of the liquid in the liquid channels.

Moreover, if the machine relates to a machine of BE2017/5459, it means the magnets embedded in the outer rotor can be actively cooled as well.

BRIEF DESCRIPTION OF THE INVENTION

With the intention of better showing the characteristics of the invention, a few preferred embodiments of a cylindrical symmetric volumetric machine according to the invention are described hereinafter by way of an example, without any limiting nature, with reference to the accompanying drawings, wherein:

FIG. 1 schematically shows a machine according to the invention;

DETAILED DESCRIPTION OF THE INVENTION

Figure 1:
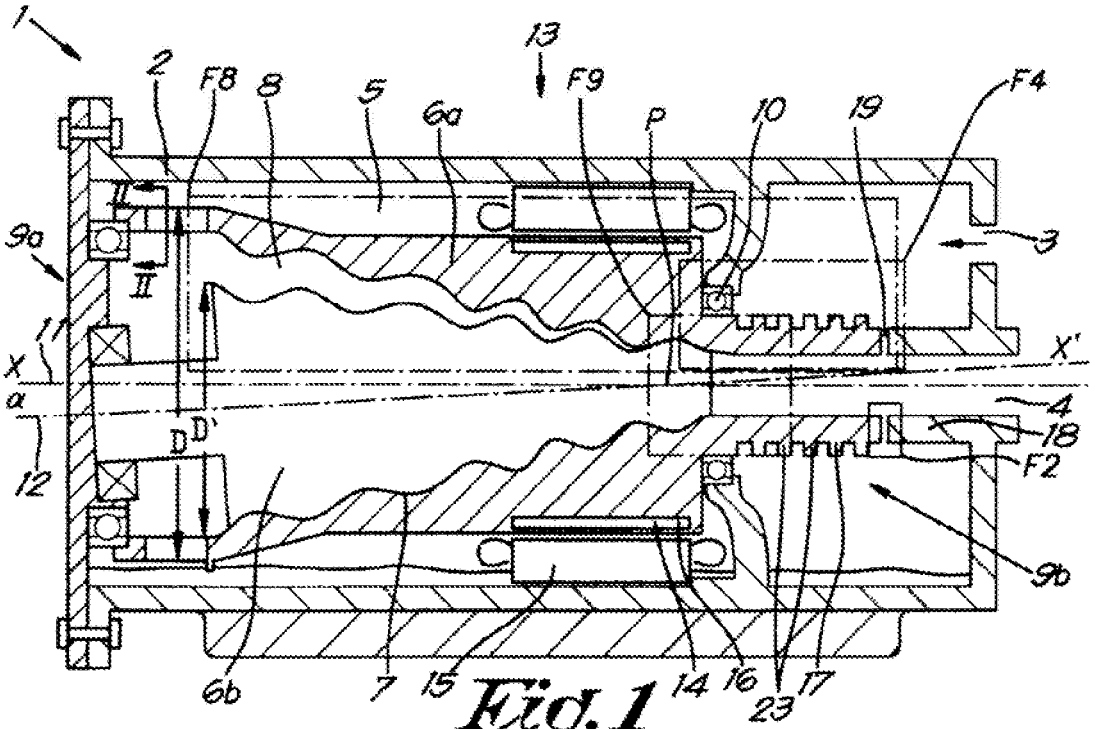

The machine 1 schematically shown in FIG. 1 is a compressor device in this case.

According to the invention it is also possible that the machine 1 relates to an expander device. The invention can also relate to a pump device.

The machine 1 is a cylindrical symmetric volumetric machine 1. This means the machine 1 has a cylindrical symmetry, i.e. the same symmetrical properties as a cone.

The machine 1 comprises a housing 2 that is provided with an inlet opening 3 to suck in gas to be compressed and with an outlet opening 4 for compressed gas. The housing defines a chamber 5.

Two co-operating rotors 6*a*, 6*b*, namely an outer rotor 6*a* mounted rotatably in the housing 2 and an inner rotor 6*b* mounted rotatably in the outer rotor 6*a* are located in the chamber 5 in the housing 2 of the machine 1.

Both rotors 6*a*, 6*b* are provided with lobes 7 and can turn into each other co-operatively, whereby between the lobes 7 a compression chamber 8 is created, the volume of which can be reduced by the rotation of the rotors 6*a*, 6*b*, such that the gas that is caught in this compression chamber 8 is compressed. The principle is very similar to the known adjacent co-operating screw rotors.

The rotors 6*a*, 6*b* are mounted on bearings in the machine 1, whereby the inner rotor 6*b* on one end 9*a* is mounted in the machine 1 on a bearing and the other end 9*b* of the inner rotor 6*b* is supported or borne by the outer rotor 6*a* as it were.

In the example shown, the outer rotor 6*a* is mounted at both ends 9*a*, 9*b* in the machine 1 on bearings. At least one axial bearing 10 is used for this.

The end 9*a* will also be referred to as the inlet side 9*a* of the inner and outer rotor 6*a*, 6*b* and the end 9*b* of the inner and outer rotor 6*a*, 6*b* will be referred to as the outlet side 9*b* in what follows.

Said compression chamber 8 between the inner and outer rotor 6*a*, 6*b* will move from the inlet side 9*a* to the outlet side 9*b* by the rotation of the rotors 6*a*, 6*b*.

In the example shown the rotors 6*a*, 6*b* have a conical shape, whereby the diameter D, D' of the rotors 6*a*, 6*b* decreases in the axial direction X-X'. However, this is not necessary for the invention; the diameter D, D' of the rotors 6*a*, 6*b* can also be constant or vary in another way in the axial direction X-X'.

Such design of rotors 6*a*, 6*b* is suitable both for a compressor and expander device. Alternatively, the rotors 6*a*, 6*b* can also have a cylindrical form with a constant diameter D, D'. They can then either have a variable pitch, such that there is a built-in volume ratio, in the case of a compressor or expander device, or a constant pitch, in the case the machine 1 relates to a pump device.

The axis 11 of the outer rotor 6*a* and the axis 12 of the inner rotor 6*b* are fixed axes 11, 12, this means that the axes 11, 12 will not move in relation to the housing 2 of the machine 1, however they do not run parallel, but are located at an angle $\alpha$ in relation to each other, whereby the axes intersect in point P.

However, this is not necessary for the invention. For example, if the rotors 6*a*, 6*b* have a constant diameter D, D', the axes 10, 11 can run parallel.

Further, the machine 1 is also provided with an electric motor 13 which will drive the rotors 6*a*, 6*b*. This motor 13 is provided with a motor rotor 14 and a motor stator 15.

In this case, but not necessarily, the electric motor 13 is mounted around the outer rotor 6*a* whereby the motor stator 15 directly drives the outer rotor 6*a*.

In the example shown this is realised because the outer rotor 6*a* also serves as motor rotor 14.

The electric motor 13 is provided with permanent magnets 16 which are embedded in the outer rotor 6*a*.

It is also possible of course that these magnets 16 are not embedded in the outer rotor 6*a*, but are mounted on the outside thereof for example.

Instead of an electric motor 13 with permanent magnets 16 (i.e. a synchronous permanent magnet motor), an asynchronous induction motor can also be applied, whereby the magnets 16 are replaced with a squirrel-cage rotor. Induction from the motor stator generates a current in the squirrel-cage rotor.

On the other hand, the motor 13 can also be a reluctance type or induction type or a combination of types.

The motor stator 15 is mounted around the outer rotor 6*a* in a covering way, whereby in this case it is located in the housing 2 of the machine 1.

In this way the lubrication of the motor 13 and the rotors 6*a*, 6*b* can be lubricated together, as they are located in the same housing 2 and consequently are not closed off from each other.

In the example shown in FIG. 1, the outer rotor 6*a* has an axial extension 17 on the level of the outlet opening 4.

This axial extension 17 extends around the outlet opening 4 in the housing 2, and almost up against the housing 2.

In FIG. 1 the housing 2 is provided with a similar axial extension 18 around the outlet opening, toward the axial extension 17 of the outer rotor 6*a*, but this is not necessarily the case.

Figure 2:
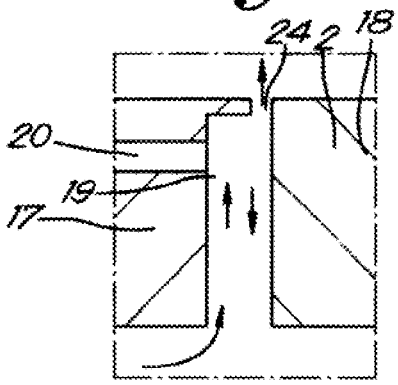
FIG. 2 shows the section indicated in FIG. 1 by F2 on a larger scale.

There is a space 19 or opening between the housing 2 and the axial extension, as shown in detail in FIG. 2.

In this way liquid separation will take place at the outlet opening 4 on the level of the inner rotor 6*a* and the outer rotor 6*b* via said space 19, because the liquid particles are flung to the space 19 under the influence of the centrifugal force.

A liquid channel 20 extends in the axial extension 17 which ends in said space 19 and which will collect and drain the separated liquid particles.

Figure 3:
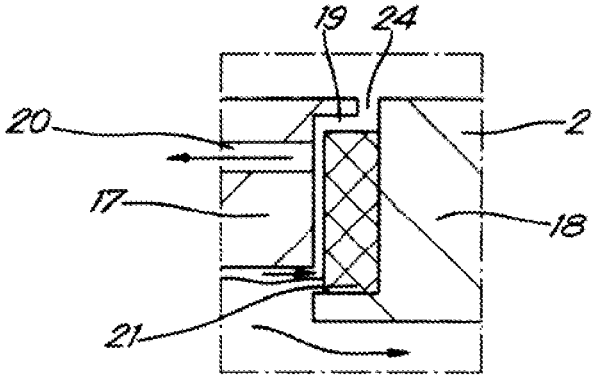
FIG. 3 shows a variant of FIG. 2.

It is possible that in said space 19 between the axial extension 17 and the housing 2, a porous liquid absorbing material 21 has been applied, as shown in FIG. 3.

Said porous material 21 can for example be metal foam.

Figure 4:
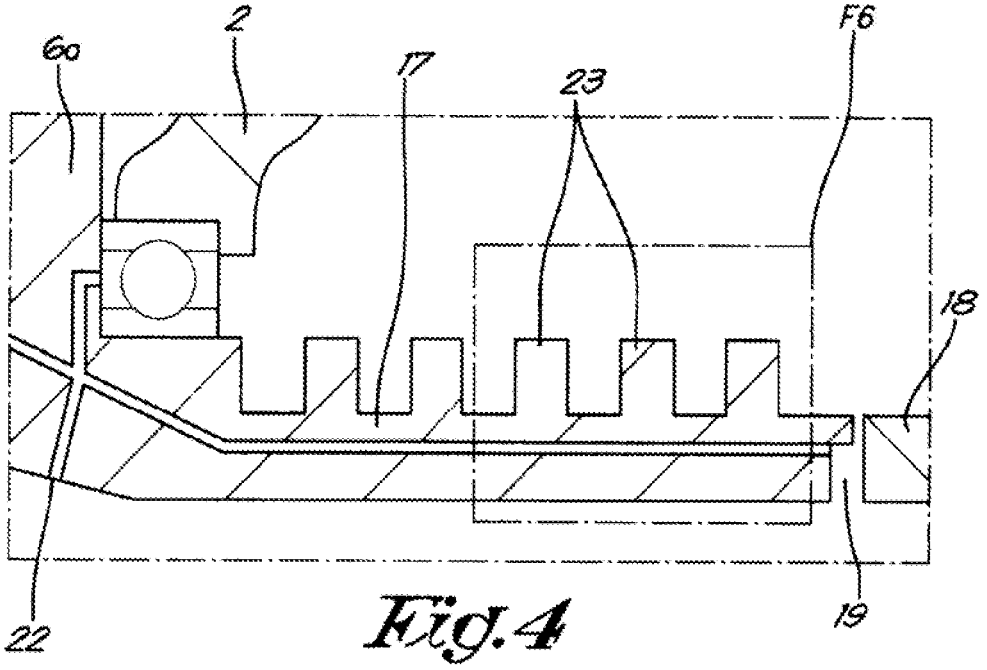
FIG. 4 shows the section indicated in FIG. 1 by F4 on a larger scale.

Said liquid channels 20 extend through the outer rotor 6*a*, as shown in FIG. 4.

In the example of FIG. 4, the liquid channels 20 lead to the bearings 10 of the outer rotor 6*a* and to an injection point 22 to the space between the inner rotor 6*a* and the outer rotor 6*b*.

As shown in FIG. 4, the liquid channels 20 extend further, and further on in the inner rotor 6*a*, more toward the inlet side 9*a*, they will lead to one or more additional injection points 22 to the space between the inner rotor 6*a* and the outer rotor 6*b*.

This means liquid can be injected at various points 22 along the entire length of the inner and outer rotor 6*a*, 6*b* instead of only along the inlet side 9*a* such as with the known machines 1.

As shown in FIGS. 1 and 4, the outer rotor 6*a* is provided with one or more cooling fins 23.

They are applied on the axial extension 17 of the outer rotor 6*a*, but they can be applied anywhere on the outer rotor 6*a*.

In FIG. 4 they are perpendicular to the surface of the outer rotor 6*a*, but this is not necessarily the case.

Figure 5:
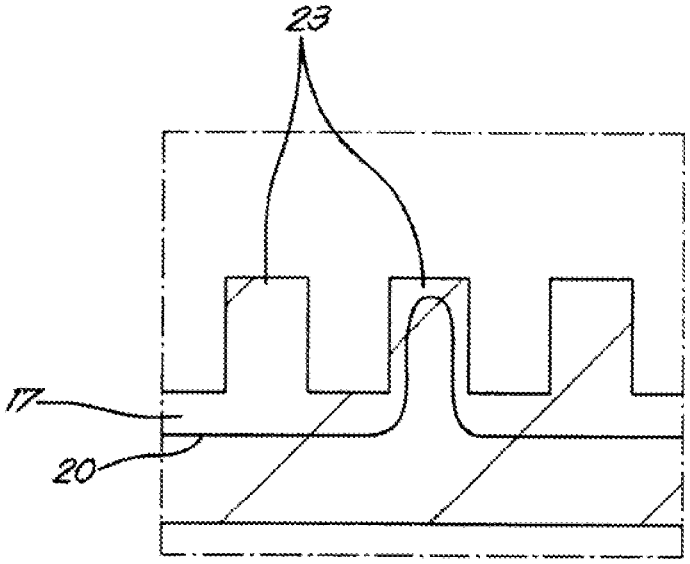
FIG. 5 shows the section indicated in FIG. 4 by F5 on a larger scale.

From the detail in FIG. 5 it is clear that the liquid channels 20 extend through these cooling fins 23.

The operation of the machine 1 is very simple and as follows.

During the operation of the machine 1, the motor stator 15 will drive the motor rotor 14 and therefore drive the outer rotor 6*a* in the known way.

The outer rotor 6*a* will help drive the inner rotor 6*b*, and the rotation of the rotors 6*a*, 6*b* sucks in gas via the inlet opening 3, which will end up in a compression chamber 8 between the rotors 6*a*, 6*b*. When the gas is sucked in via the inlet opening 3, it will flow past the cooling fins 23, the motor rotor 14 and the motor stator 15. In this way the gas will cool the motor 13 as well as the cooling fins 23 and thus the liquid flowing via the cooling fins 23.

Due to the rotation, this compression chamber 8 moves to the outlet 4 and at the same time will reduce in terms of volume to thus realise a compression of the gas.

During the compression, liquid is injected via the injection points 22 which end in the space between the inner rotor 6*a* and the outer rotor 6*b* and in the bearings 10.

When the gas has reached the outlet side 9*b* of the inner and outer rotor 6*a*, 6*b*, it will contain liquid particles.

Due to the rotation of the inner and outer rotor 6*a*, 6*b*, the liquid particles are flung outward radially and separated to the space 19, where they end up in the liquid channel 20. The built-up pressure on the outlet side 9*b* will be used to inject the liquid in the machine 1.

To prevent that the liquid particles which were flung to the space 19 are dragged to the outlet 4 together with the compressed gas, the liquid absorbing material 21 can be mounted in the space as shown in FIG. 3, which will catch the liquid particles as it were.

Also, due to the liquid present, a slide bearing is created in the space 19 between the axial extension 17 and the housing 2.

This slide bearing will be able to accommodate axial forces, such that the bearing 10 needs to be able to accommodate less forces and it can be made smaller and/or lighter.

A small part of the liquid will be able to leave the space 19 via the opening 24 at the outer perimeter side.

Said effect will separate the liquid from the compressed gas at the outlet side 9*b* of the rotors 6*a*, 6*b*.

The compressed gas can then exit the machine 1 via the outlet opening 4.

Said liquid can both be water and a synthetic oil, or non-synthetic oil.

In the example of FIGS. 1 to 5, the liquid is cooled because the liquid channels 20 extend through the cooling fins 23. The cooling fins 23 are air-cooled, and in turn will draw heat away from the liquid flowing through the cooling fins.

It is also possible that no cooling fins 23 are provided but that alternatively the liquid channels 20 at least partially run via a liquid pipe 24 mounted on the surface of the outer rotor 6*a*.

Figure 6:
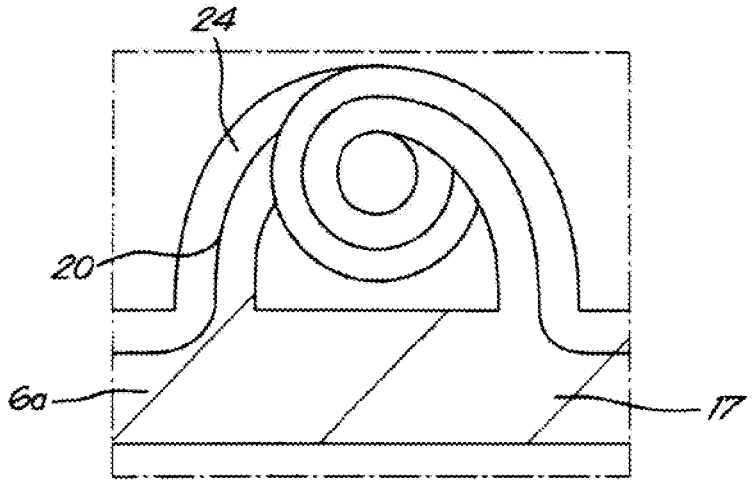
FIG. 6 shows a variant of FIG. 5.

FIG. 6 shows such liquid pipe 24, whereby the pipe has a curved shape, in order to mount the longest possible pipe in a compact way on the outer rotor 6*a*. It is clear that the exact shape of the liquid pipe 24 is not restrictive for the invention. One could indeed conceive other shapes which provide the same result.

Such liquid pipe 24 is air-cooled in a similar way as the cooling fins 23.

Figure 7:
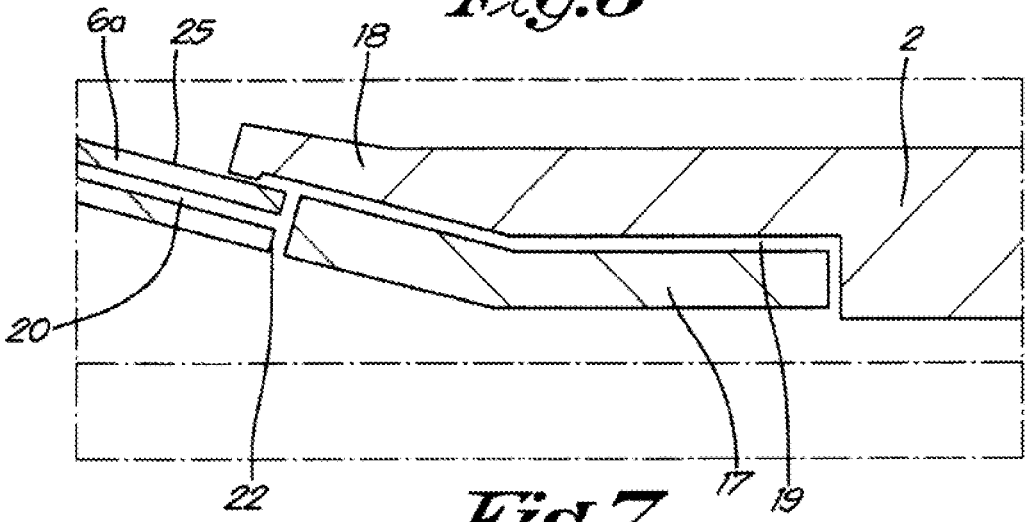
FIG. 7 shows another embodiment of FIG. 4.

FIG. 7 shows an alternative for the embodiment of FIGS. 2 and 3.

The outer rotor 6*a* hereby has a section 25 with a conical cross-section which connects to the axial extension 17.

In FIG. 7 the inner rotor 6*b* and the outer rotor 6*a* have a conical shape, such that the section of the outer rotor 6*a*, which connects to the axial extension 17, will form said conical section 25.

If the outer rotor 6*a* does not have a conical shape, a section of the axial extension 17 can have a conical shape instead.

Further, the housing 2 is provided with a corresponding extension 18 which fits over or around the axial extension 17 of the outer rotor 6*a* and at least partially over or around the conical section 25 of the outer rotor 6*a*, whereby there is a space 19 between the extension 18 of the housing 2 on the one hand and the axial extension 17 of the outer rotor 6*a* and the conical section 25 on the other hand.

It is important that the housing 2 does not touch the outer rotor 6*a* anywhere.

In the axial extension 17 and/or in the conical section 25 a liquid channel 20 is mounted that ends in said space 19.

During the operation of the machine 1 liquid will end up again in the space 19, which can be injected back in the machine 1 via the liquid channels 20.

Such configuration will create a conical axial slide bearing with a radial slide bearing.

Figure 8:
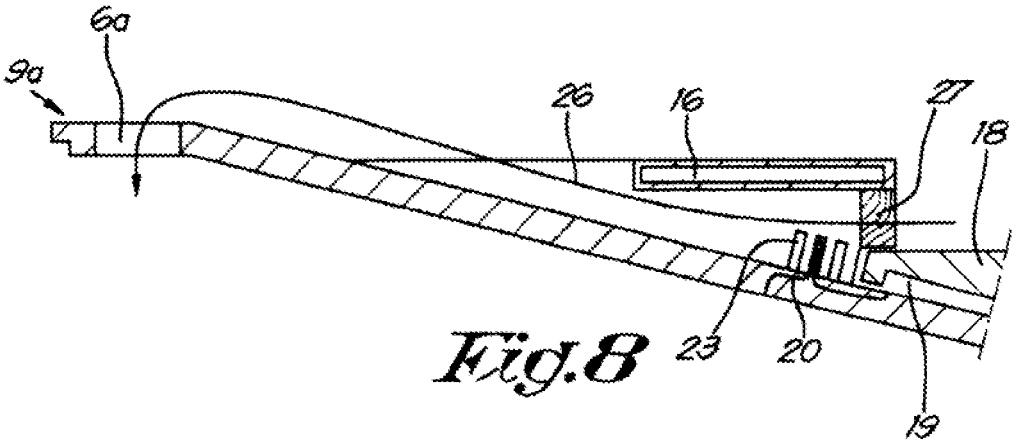
FIG. 8 shows the section indicated in FIG. 1 by F8 on a larger scale.

As a result of this, the bearing 10 is not only relieved, but it can even be left out, as schematically shown in FIG. 8, which shows a variant of the section indicated in FIG. 1 by F8.

Further, in FIG. 8 the outer rotor 6*a* is provided with cooling fins 23 which have been mounted on the surface of the outer rotor 6*a* itself and therefore not on the axial extension 17 as in FIG. 1.

Furthermore, the outer rotor 6*a* has an open structure with passages 26 for the sucked in gas, whereby it is so that gas that is sucked in via the inlet opening 3, must pass via the passages 26 before it ends up between the inner rotor 6*b* and the outer rotor 6*a* on the inlet side 9*a* of the rotors 6*a*, 6*b*.

This has the advantage that the magnets 16 are actively cooled by the gas flowing in. Furthermore, the motor stator 15 does not need any slots to let the air through from the inlet opening 3 to the inlet side 9*a* of the rotors 6*a*, 6*b*.

Additionally, but not necessarily, the outer rotor 6*a* is provided with an axial ventilator 27 on the level of the inlet opening 3 in the form of blades mounted in the open structure.

This will help to suck in gas and build up pressure such that a better filling ratio of the compression chamber 8 is obtained.

Figure 9:
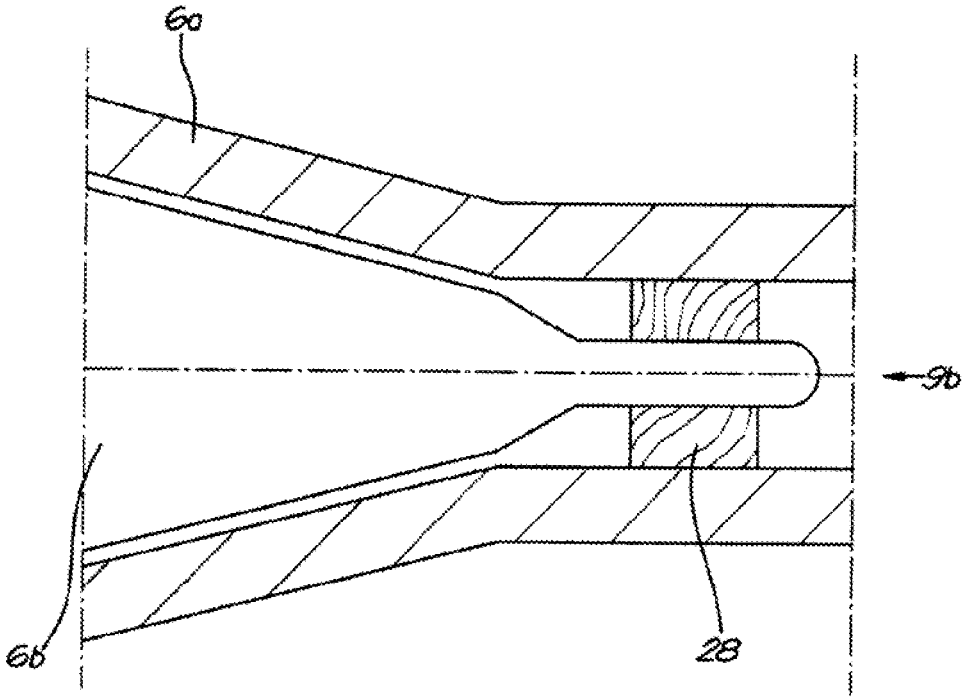
FIG. 9 shows the section indicated in FIG. 1 by F9 on a larger scale.

FIG. 9 shows another additional element which can be applied in all said embodiments. It relates to means to obtain a pre-separation of the liquid, i.e. before the separation that occurs on the level of the outlet opening 4.

To this end the inner rotor 6*b*, on the level of the end of the inner rotor 6*b* on the outlet side 9*b*, is provided with blades 28 along which the gas passes before it leaves the machine 1 via the outlet opening 4.

It is not excluded that the blades 4 are provided on the outer rotor 6*a* or that both the outer rotor 6*a* and the inner rotor 6*b* are provided with such blades 28.

Due to their rotation the blades 28 will strengthen and support the separation further up, such that the overall efficiency of the separation, or the total amount of the separated liquid, ends up much higher.

Alternatively or additionally to said liquid channels 20, it is also possible that at least a part of the separated liquid is collected in a reservoir that is located under the outer rotor 6*a* in the housing 2.

Part of, or all the separated liquid can then flow down via the spaces 19 toward the reservoir instead of ending up in the channels 20.

The outer rotor 6*a* is hereby provided with one or more radially oriented fingers, ribs or the like along the outer surface on the inlet side 9*a*.

It is such that during the rotation of the outer rotor 6*a* these fingers move through the liquid in the reservoir and thus move around and carry along the liquid such that this liquid can end up in the machine 1 again.

This is so-called 'splash' lubrication, whereby the moved around liquid ends up on the inlet side 9*a* between the rotors.

It is possible that on the outside of the housing 2, on the level of the reservoir, cooling fins are provided, which ensure that the liquid in the reservoir can be cooled.

The present invention is by no means limited to the embodiments described as an example and shown in the drawings, but a cylindrical symmetric volumetric machine according to the invention can be realised in all kinds of forms and dimensions, without departing from the scope of the invention.

The invention claimed is:

1. A cylindrical symmetric volumetric machine, comprising a housing (2) with an inlet opening (3) and an outlet opening (4), with two co-operating rotors (6*a*, 6*b*) in the housing (2), including an outer rotor (6*a*) which is mounted rotatably in the housing (2) and an inner rotor (6*b*) which is mounted rotatably in the outer rotor (6*a*), whereby liquid is injected in the machine (1), wherein at the outlet opening (4) on the level of the inner rotor (6*b*) and outer rotor (6*a*) a liquid separation takes place, whereby the separated liquid ends up in the machine (1) again via a space (19), and wherein the outer rotor (6*a*) has an axial extension (17) on the level of the outlet opening (4) which extends around this outlet opening (4) almost up against the housing (2) such that the space (19) is located between the axial extension (17) and the housing (2) in an axial direction of the cylindrical symmetric volumetric machine, the space configured to receive the separated liquid.

2. The cylindrical symmetric volumetric machine according to claim 1, wherein in said space (19) between the axial extension (17) and the housing (2) a porous liquid absorbing material (21) is applied.

3. The cylindrical symmetric volumetric machine according to claim 1, wherein the outer rotor (6*a*) has a section (25) with a conical cross-section that connects to the axial extension (17) and that the housing (2) is provided with a corresponding extension (18) which fits over or around the axial extension (17) and at least partially over or around the conical section (25) of the outer rotor (6*a*), whereby the space (19) is between the extension (18) of the housing (2) and the axial extension (17) of the outer rotor (6*a*), and the space is further between the extension (18) of the housing (2) and the conical section (25).

4. The cylindrical symmetric volumetric machine according to claim 1, wherein at least part of the separated liquid ends up in the machine (1) again via liquid channels (20) in the outer rotor (6*a*).

5. The cylindrical symmetric volumetric machine according to claim 1, wherein in the axial extension (17) a liquid channel (20) extends that ends in the space (19) between the housing (2) and the axial extension (17).

6. The cylindrical symmetric volumetric machine according to claim 4, wherein the liquid channels (20) in the outer rotor (6*a*) lead to one or more of the following locations:

one or more injection points (22) to a space between the inner rotor (6*b*) and the outer rotor (6*a*);

one or more injection points to one or more bearings (10) of the machine (1).

7. The cylindrical symmetric volumetric machine according to claim 4, wherein the outer rotor (6*a*) is provided with one or more cooling fins (23).

8. The cylindrical symmetric volumetric machine according to claim 7, wherein the liquid channels (20) extend at least partially through an inside of the cooling fins (23).

9. The cylindrical symmetric volumetric machine according to claim 4, wherein the liquid channels (20) run at least partially via a liquid pipe (24) mounted on the surface of the outer rotor (6*a*).

10. The cylindrical symmetric volumetric machine according to claim 1, wherein on the level of the end (9*b*) of the inner rotor (6*b*) on the outlet opening (4), the inner rotor (6*b*) and/or the outer rotor (6*a*) is provided with blades (28) along which the gas passes before leaving the machine (1) via the outlet opening (4).

11. The cylindrical symmetric volumetric machine according to claim 9, wherein the outer rotor (6*a*) on the level of the inlet opening (3) is provided with an axial ventilator (27) in the form of blades mounted in the open structure.

12. The cylindrical symmetric volumetric machine according to claim 1, wherein the liquid is water or oil.

13. The cylindrical symmetric volumetric machine according to claim 1, wherein the inner rotor (6*b*) and the outer rotor (6*a*) have a conical shape.

14. The cylindrical symmetric volumetric machine according to claim 1, wherein the machine (1) is provided with an electric motor (13) with a motor rotor (14) and motor stator (15) to drive the inner and outer rotor (6*a*, 6*b*), whereby the electric motor is mounted (13) around the outer rotor (6*a*), whereby the motor stator (15) directly drives the outer rotor (6*a*).

15. The cylindrical symmetric volumetric machine according to claim 14, wherein the outer rotor (6*a*) serves as the motor rotor (14).

16. The cylindrical symmetric volumetric machine according to claim 15, wherein the electric motor (13) is provided with permanent magnets (16) embedded in the outer rotor (14*a*).

17. The cylindrical symmetric volumetric machine according to claim 1, wherein the outer rotor (6*a*) comprises the axial extension (17) and a portion with lobes that defines a part of a compression chamber (8) between the outer rotor (6*a*) and the inner rotor (6*b*), the axial extension (17) extends linearly in the axial direction of the cylindrical symmetric volumetric machine and does not include lobes, and an axial end surface of the axial extension (17) defines a part of the space.

18. A cylindrical symmetric volumetric machine, comprising a housing (2) with an inlet opening (3) and an outlet opening (4), with two co-operating rotors (6*a*, 6*b*) in the housing (2), including an outer rotor (6*a*) which is mounted rotatably in the housing (2) and an inner rotor (6*b*) which is mounted rotatably in the outer rotor (6*a*), whereby liquid is injected in the machine (1), wherein at the outlet opening (4) on the level of the inner rotor (6*b*) and outer rotor (6*a*) a liquid separation takes place, whereby the separated liquid ends up in the machine (1) again, and wherein the outer rotor (6*a*) has an axial extension (17) on the level of the outlet opening (4) which extends around this outlet opening (4) almost up against the housing (2) such that a space (19) is located between the axial extension (17) and the housing (2), wherein at least part of the separated liquid is collected in a reservoir that is located under the outer rotor (6*a*) in the housing (2), whereby the outer rotor (6*a*) is provided with one or more radially oriented fingers or ribs along the outer surface on the inlet side (9*a*), which during rotation of the outer rotor (6*a*) will move through the liquid in the reservoir and thus carry along liquid such that this liquid ends up in the machine (1) again.

19. The cylindrical symmetric volumetric machine according to claim 18, wherein the housing (2) on the outside, on the level of the reservoir, is provided with cooling fins.

20. A cylindrical symmetric volumetric machine, comprising a housing (2) with an inlet opening (3) and an outlet opening (4), with two co-operating rotors (6*a*, 6*b*) in the housing (2), including an outer rotor (6*a*) which is mounted rotatably in the housing (2) and an inner rotor (6*b*) which is mounted rotatably in the outer rotor (6*a*), whereby liquid is injected in the machine (1), wherein at the outlet opening (4) on the level of the inner rotor (6*b*) and outer rotor (6*a*) a liquid separation takes place, whereby the separated liquid ends up in the machine (1) again, and wherein the outer rotor (6*a*) has an axial extension (17) on the level of the outlet opening (4) which extends around this outlet opening (4) almost up against the housing (2) such that a space (19) is located between the axial extension (17) and the housing (2), wherein the outer rotor (6*b*) has an open structure with passages (26) for the sucked in gas, such that gas that is sucked in via the inlet opening (3), has to pass via the passages (26) of the open structure before it ends up between the inner rotor (6*b*) and the outer rotor (6*a*).

* * * * *